US011225815B2

(12) United States Patent
Nagata et al.

(10) Patent No.: US 11,225,815 B2
(45) Date of Patent: Jan. 18, 2022

(54) VEHICLE SIDE DOOR LATCH APPARATUS

(71) Applicant: MITSUI KINZOKU ACT CORPORATION, Yokohama (JP)

(72) Inventors: Taichiro Nagata, Yokohama (JP); Yasuhiro Kubota, Yokohama (JP)

(73) Assignee: Mitsui Kinzoku Act Corporation, Yokohama (JP)

( * ) Notice: Subject to any disclaimer, the term of this patent is extended or adjusted under 35 U.S.C. 154(b) by 749 days.

(21) Appl. No.: 16/022,211

(22) Filed: Jun. 28, 2018

(65) Prior Publication Data

US 2019/0024420 A1 Jan. 24, 2019

(30) Foreign Application Priority Data

Jul. 19, 2017 (JP) ..... JP2017-139725

(51) Int. Cl.

| | |
|---|---|
| ***E05B 81/22*** | (2014.01) |
| ***E05B 85/06*** | (2014.01) |
| ***E05B 81/14*** | (2014.01) |
| ***E05B 81/24*** | (2014.01) |
| ***E05B 81/90*** | (2014.01) |

(Continued)

(52) U.S. Cl.

CPC ..... *E05B 81/22* (2013.01); *E05B 81/14* (2013.01); *E05B 81/25* (2013.01); *E05B 81/90* (2013.01); *E05B 85/06* (2013.01); *E05B 77/40* (2013.01); *E05B 83/36* (2013.01)

(58) Field of Classification Search

CPC ..... E05B 81/22; E05B 81/14; E05B 81/25; E05B 81/90; E05B 85/06; E05B 77/40; E05B 83/36; Y10T 292/699; Y10T 292/1082; Y10T 292/1047; Y10S 292/23

USPC ..... 292/341.16

See application file for complete search history.

(56) References Cited

U.S. PATENT DOCUMENTS 5,169,186 A * 12/1992 Fukumoto ..... E05B 77/34 292/201

5,454,607 A * 10/1995 Ishihara ..... E05B 81/20 292/201

(Continued)

FOREIGN PATENT DOCUMENTS

| | | |
|---|---|---|
| CN | 104956019 A | 9/2015 |
| GB | 2376501 A | 12/2002 |

(Continued)

*Primary Examiner* — Kristina R Fulton
*Assistant Examiner* — Steven A Tullia
(74) *Attorney, Agent, or Firm* — Knobbe, Martens, Olson & Bear, LLP

(57) ABSTRACT

A compact vehicle side door latch apparatus has a latch that is rotated from an unlatched position to a fully-latched position, a ratchet that engages the latch in order to prevent the latch from being rotated in a releasing direction, a door opening link that is moved in a door opening direction in order to allow the ratchet to be disengaged from the latch, a motor that moves the door opening link in the door opening direction by motor power, and a door key lever that moves the door opening link in the door opening direction by an operation of a key plate. The door key lever is connected to the door opening link with play, and the motor power is transmitted to the door opening link without passing through disconnecting means of the power transmission path.

5 Claims, 14 Drawing Sheets

(51) Int. Cl.
*E05B 77/40* (2014.01)
*E05B 83/36* (2014.01)

(56) References Cited

U.S. PATENT DOCUMENTS 5,454,627 A * 10/1995 Kawabe ..... G01M 1/16 301/5.21
6,997,488 B2 * 2/2006 Kurten ..... E05B 81/14 292/201
7,789,440 B2 * 9/2010 Graute ..... E05B 77/38 292/216
8,474,888 B2 * 7/2013 Tomaszewski ..... E05B 77/30 292/201
9,353,556 B2 * 5/2016 Margheritti ..... E05B 81/54
9,670,700 B2 * 6/2017 Hanaki ..... E05B 81/20
2004/0262945 A1 * 12/2004 Suzuki ..... E05B 65/0811 296/155
2005/0258652 A1 * 11/2005 Usuzaki ..... E05B 17/042 292/216
2008/0078215 A1 * 4/2008 Odahara ..... E05B 81/16 70/91
2012/0139269 A1 * 6/2012 Kouzuma ..... E05B 79/20 292/195
2014/0053618 A1 * 2/2014 Yamaguchi ..... E05B 81/16 70/91
2016/0017645 A1 1/2016 Tomaszewski et al.

FOREIGN PATENT DOCUMENTS

JP H09-096146 A 4/1997
JP H09-228736 A 9/1997
JP 2000-027512 A 1/2000
JP 2002-295095 A 10/2002
JP 2014206525 * 10/2014 ..... B06J 5/00
WO 2014/082175 A1 6/2014

* cited by examiner

VEHICLE SIDE DOOR LATCH APPARATUS

The present application is based on, and claims priority from, J. P. Application No. 2017-139725, filed on Jul. 19, 2017, the disclosure of which is hereby incorporated by reference herein in its entirety.

BACKGROUND OF THE INVENTION

1. Field of the Invention

The present invention relates to a vehicle side door latch apparatus, and particularly to a vehicle side door latch apparatus having a power release mechanism that releases the engagement of a latch in order to open a door and/or a powered cinching mechanism that moves the latch from a half-latched position to a fully-latched position.

2. Description of the Related Art

Conventionally, there is known a vehicle door latch apparatus having a power release mechanism that releases the engagement of a latch by a motor power in order to open a door (JP2002-295095). There is also known a vehicle side door latch apparatus having a powered cinching mechanism (also called a powered door closing mechanism) that moves a latch from a half-latched position to a fully-latched position (JP09-228736, JP09-096146). A vehicle side door means a vehicle door for passengers that is provided on the side of a vehicle.

A latch housing of a vehicle side door latch apparatus is formed in an L-shaped cross section having a latch housing part that extends in the vehicle width direction and a side housing part that extends in the vehicle front-rear direction in order to avoid interference with vertical guide rails for a vertically movable side wind shield of a door (JP2000-027512).

SUMMARY OF THE INVENTION

A conventional vehicle side door latch apparatus having a powered release mechanism and/or a powered cinching mechanism is disadvantage for a large sized operation unit that houses the operation mechanism, a large sized latch unit, complicated inner mechanism and higher cost. In particular, since the latch housing is formed in an L-shaped cross section, a latch apparatus having a less restrictive and simple arrangement is required.

According an aspect of the invention, a vehicle side door latch apparatus comprises: a latch that has a half-latching step that defines a half-latched position and a fully-latching step that defines a fully-latched position and that is rotated from an unlatched position toward the fully-latched position by engaging a striker; a ratchet that engages the half-latching step and the fully-latching step in order to prevent the latch from being rotated in a releasing direction; a door opening link that is moved in a door opening direction from a waiting position in order to abut against the ratchet in order to allow the ratchet to be disengaged from the latch; a motor that moves the door opening link in the door opening direction from the waiting position; a door key lever that is connected to the door opening link with play in the door opening direction, wherein the door key lever moves the door opening link in the door opening direction from the waiting position by being rotated in a door opening direction by a key plate; and a power transmission path that does not have disconnecting means thereof and that always transmits power of the motor to the door opening link.

According to the invention of claim 1, the engagement of the latch can be released only by activating the door opening link by means of motor power in daily operation. Thus, the vehicle side door latch apparatus can be significantly simplified as compared to a conventional latch apparatus having a complex structure and also has cost savings benefits.

According to the invention of claim 2, it is possible to cope with malfunction of the motor because the door opening link in the waiting position can be moved in the door opening direction by the inside door opening handle.

According to the invention of claim 3, a first cinching lever with a simplified structure can be provided.

According to the invention of claim 4, power transmission of the powered cinching mechanism can be disconnected by activating the motor and thereby rotating the clutch lever via the door opening link. Thus, it is possible to prevent the powered cinching mechanism from hindering the releasing rotation of the latch that is caused by malfunction of the power unit.

According to the invention of claim 5, the elastic force of the clutch spring makes it possible for the clutch lever to return smoothly.

According to the invention of claim 6, the power unit can be shielded from the inside of the vehicle by a sound insulating and absorbing cover that is attached to the inside door panel. Thus, sound pressure and sound quality of the operation sound of the power unit, that are comfortable to the users, can be achieved.

According to the invention of claim 7, the operation noise of the power unit can be effectively limited by the soundproofing closed housing.

According to another aspect of the invention, a vehicle side door latch apparatus comprises: a housing that includes a side housing portion and a front housing portion that is bent from the side housing portion, wherein the housing is formed in an L-shape, as seen from above; latch that is housed in the front housing portion, that has a half-latching step that defines a half-latched position and a fully-latching step that defines a fully-latched position and that is rotated from an unlatched position toward the fully-latched position by engaging a striker; a ratchet that is housed in the front housing portion, that engages the half-latching step and the fully-latching step in order to prevent the latch from being rotated in a releasing direction and that is rotated about a ratchet shaft that extends in a vehicle front-rear direction of a vehicle; a door opening link that is housed in the side housing portion, that is moved upward in a door opening direction from a waiting position below in order to abut against the ratchet to allow the ratchet to be disengaged from the latch; a door opening lever that is housed in the side housing portion and that is rotated in a door opening direction about a door opening shaft that extends in a door width direction in order to move the door opening link that is in the waiting position in the door opening direction; a motor that is housed in the side housing portion and that moves the door opening lever in the door opening direction; a power unit that is arranged apart from the housing; a first cinching lever that is housed in the front housing portion and that is rotated about a movable shaft that extends in the vehicle front-rear direction by power of the motor in order to move the latch from the half-latched position to the fully-latched position; a door key lever that is housed in the side housing portion and that moves the door opening link in the door opening direction from the waiting position by being rotated in a door opening direction by a key plate; a casing cover that is attached to the side housing portion and that isolates the motor, the door opening lever and the door opening link from outside of the casing cover; and a power transmission path that does not have disconnecting means thereof and that always transmits power of the motor to the door opening link via the door opening lever.

The door opening lever is arranged between the door opening link and the motor, as seen in the vehicle front-rear direction, the door key lever is arranged above the door opening link, and the ratchet shaft is arranged between the latch shaft and the movable shaft in a vertical direction.

According to this invention, the engagement of the latch can only be released by activating the door opening link by using motor power in daily operation. Thus, the vehicle side door latch apparatus can be significantly simplified as compared to a conventional latch apparatus having a complex structure and there is also a cost savings benefit. Further, the latch apparatus has an outer shape similar to that of a conventional latch apparatus. This leads to cost savings and design flexibility can also be facilitated.

The above and other objects, features and advantages of the present invention will become apparent from the following description with reference to the accompanying drawings which illustrate examples of the present invention.

DETAILED DESCRIPTION OF EMBODIMENT

Figure 1:
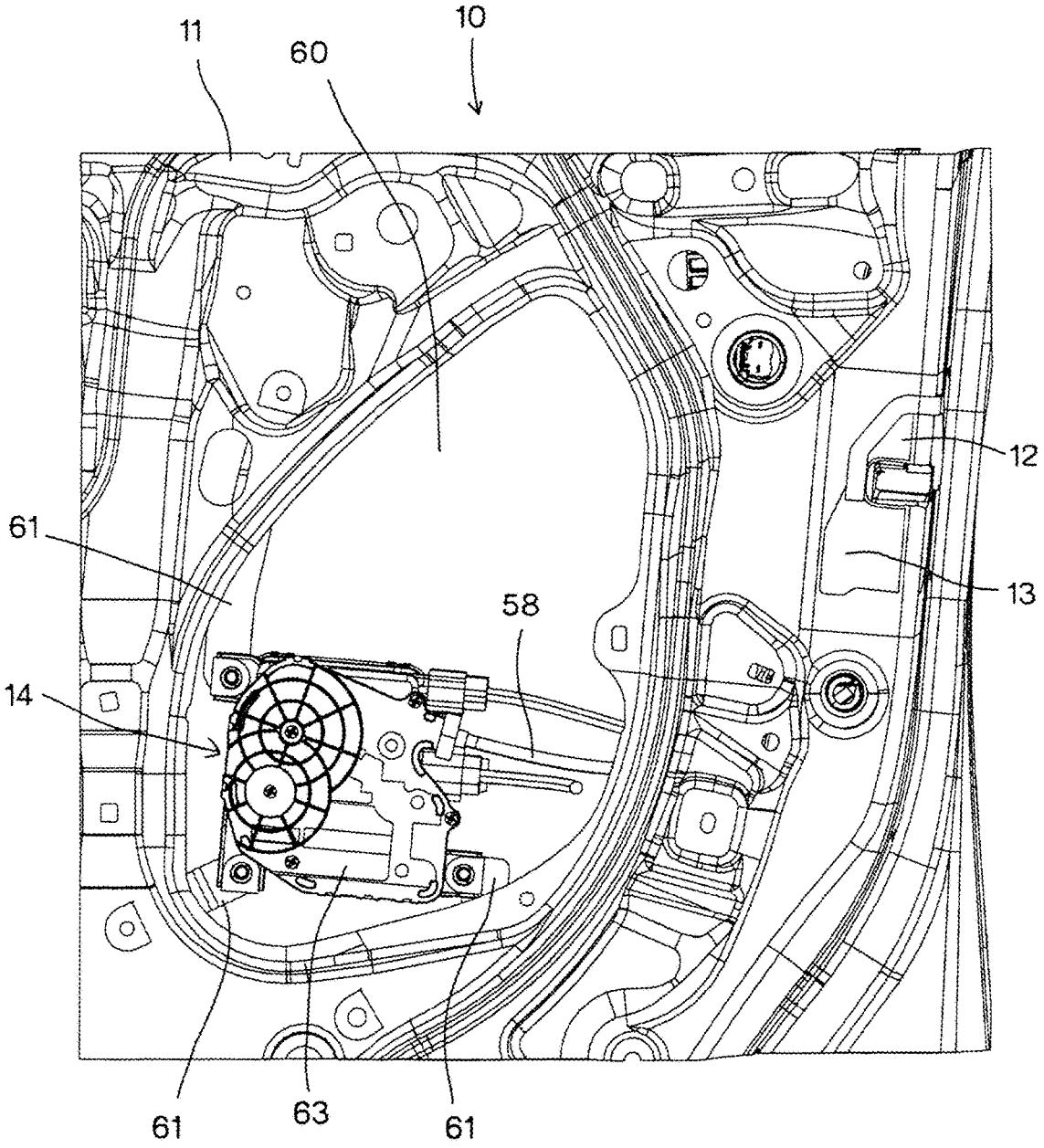
FIG. 1 is a side view of a vehicle latch apparatus of the present invention that is attached to a vehicle inside door panel, as seen from the inside of the vehicle.

An embodiment of the present invention will be described with reference to the following drawings. The present invention can be applied to a normal swing type vehicle door, but the present invention can also be applied to a sliding type vehicle door. FIG. 1 shows a latch apparatus for a vehicle side door (hereinafter simply referred to as vehicle door latch apparatus 10) of the present invention and metal inside door panel 11 of a vehicle side door to which vehicle door latch apparatus 10 is attached. FIG. 1 only illustrates the central and rear portions of inside door panel 11, and the front portion is not illustrated. A vehicle side door means a door for passengers that is arranged on the side of a vehicle. A vehicle side door is referred to as a vehicle door or simply as a door.

Vehicle door latch apparatus 10 has latch unit 12, operation unit 13 and power unit 14. Latch unit 12 is fixed to the rear end of the vehicle door (inside door panel 11). Operation unit 13 is arranged on the rear side of and adjacent to latch unit 12. Power unit 14 supplies door cinching power to operation unit 13 in order to fully latch the vehicle door. It should be noted that latch unit 12 and operation unit 13 are not strictly differentiated or separated and that these can also be understood, as a whole, to represent a latch assembly.

Figure 3:
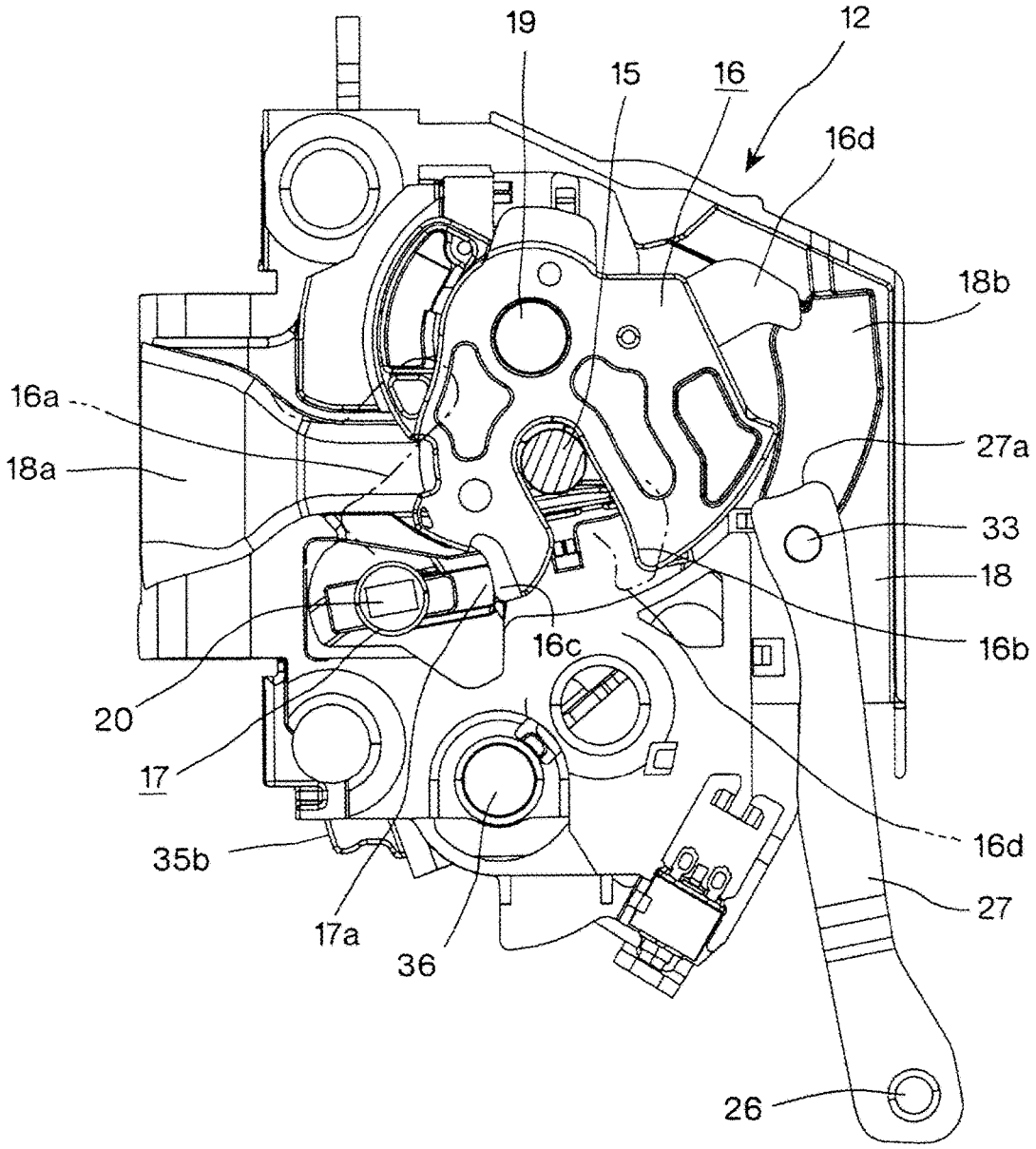
FIG. 3 is a front view of the latch unit of the vehicle latch apparatus in the fully-latched position.

Latch unit 12 is arranged at the rear end of a vehicle door, which is the part that is farthest from the rotational shaft of the vehicle door, such that the front side illustrated in FIG. 3 is directed toward the rear part of the vehicle. Latch unit 12 has latch 16 that engages striker 15 of the vehicle and ratchet 17 that keeps latch 16 engaged with striker 15. Latch 16 and ratchet 17 are housed in latch body 18 that is made of synthetic resin and are rotated about latch shaft 19 and ratchet shaft 20, respectively.

When the vehicle door is moved in the door closing direction by a sufficient manual door closing force, striker 15 goes into striker passage 18*a* that is formed in latch body 18. Striker 15 then abuts against striker engaging groove 16*a* of latch 16 in the unlatched position, that is depicted by the imaginary line in FIG. 3, in order to rotate latch 16 from the unlatched position in the fully-latching direction (in the anticlockwise direction) against the elastic force of a latch spring (not illustrated). When latch 16 comes to the half-latched position, engaging end 17*a* of ratchet 17 that is biased in the anticlockwise direction (the direction in which ratchet 17 engages latch 16) by the elastic force of a ratchet spring (not illustrated) is able to engage half-latching step 16*b* of latch 16 that defines the half-latched position. When latch 16 comes to the full-latched position, engaging end 17*a* is able to engage full-latching step 16*c* of latch 16 that defines the fully-latched position. When engaging end 17*a* of ratchet 17 engages full-latching step 16*c*, latch 16 is kept at the fully-latched position, and the door is kept closed.

Figure 2:
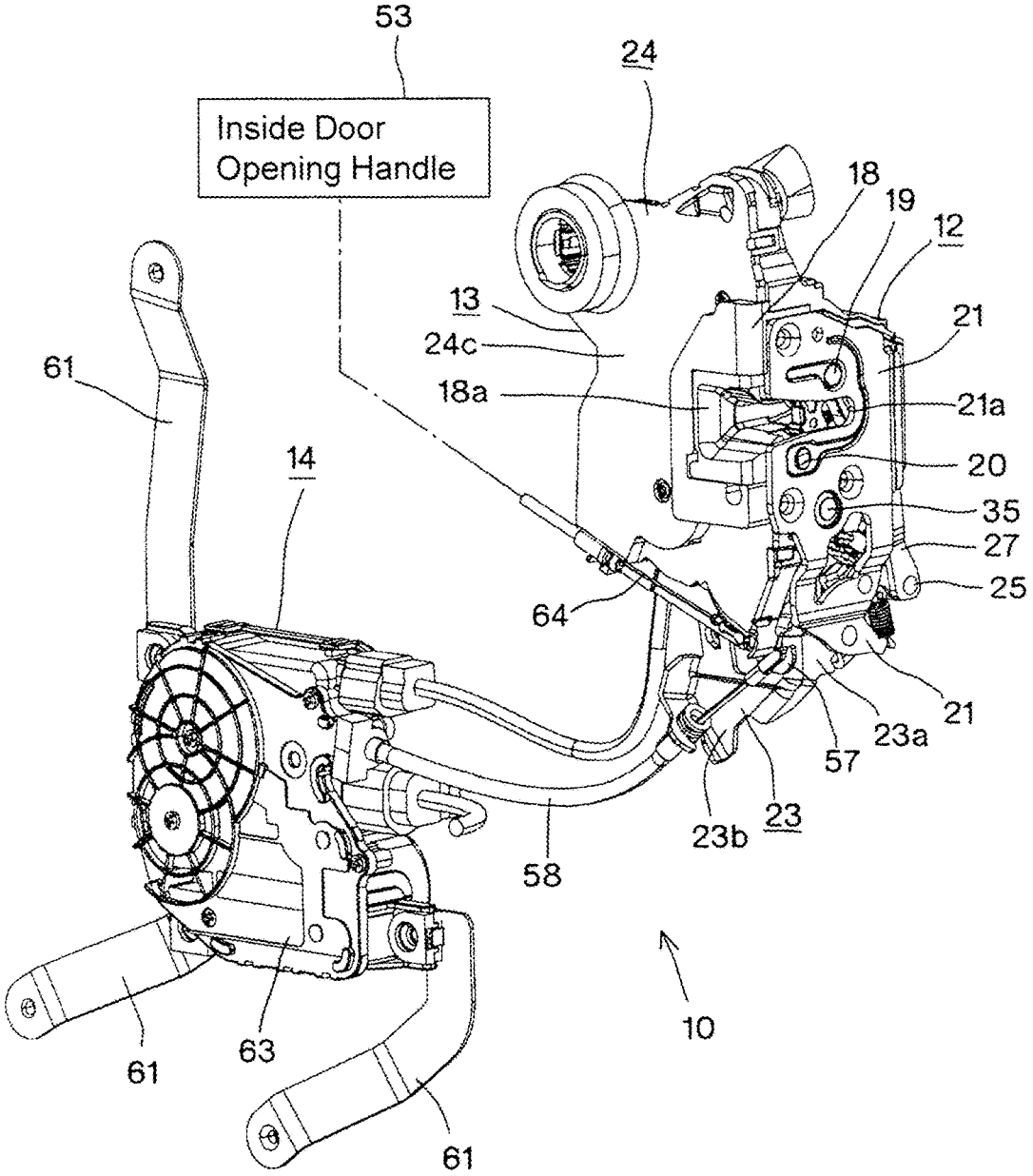
FIG. 2 is a general perspective view of the vehicle latch apparatus.

As shown in FIG. 2, metal cover plate 21 is fixed to the front surface of latch body 18, and cutaway passage 21*a* that corresponds to striker passage 18*a* is formed in cover plate 21. When the vehicle door is an ordinary swing type door (a door with vertical hinges), latch shaft 19 and ratchet shaft 20 extend in the vehicle front-rear direction of the vehicle, and striker passage 18*a* and cutaway passage 21*a* are horizontally arranged in parallel with the door width direction (the right-left direction)

Figure 4:
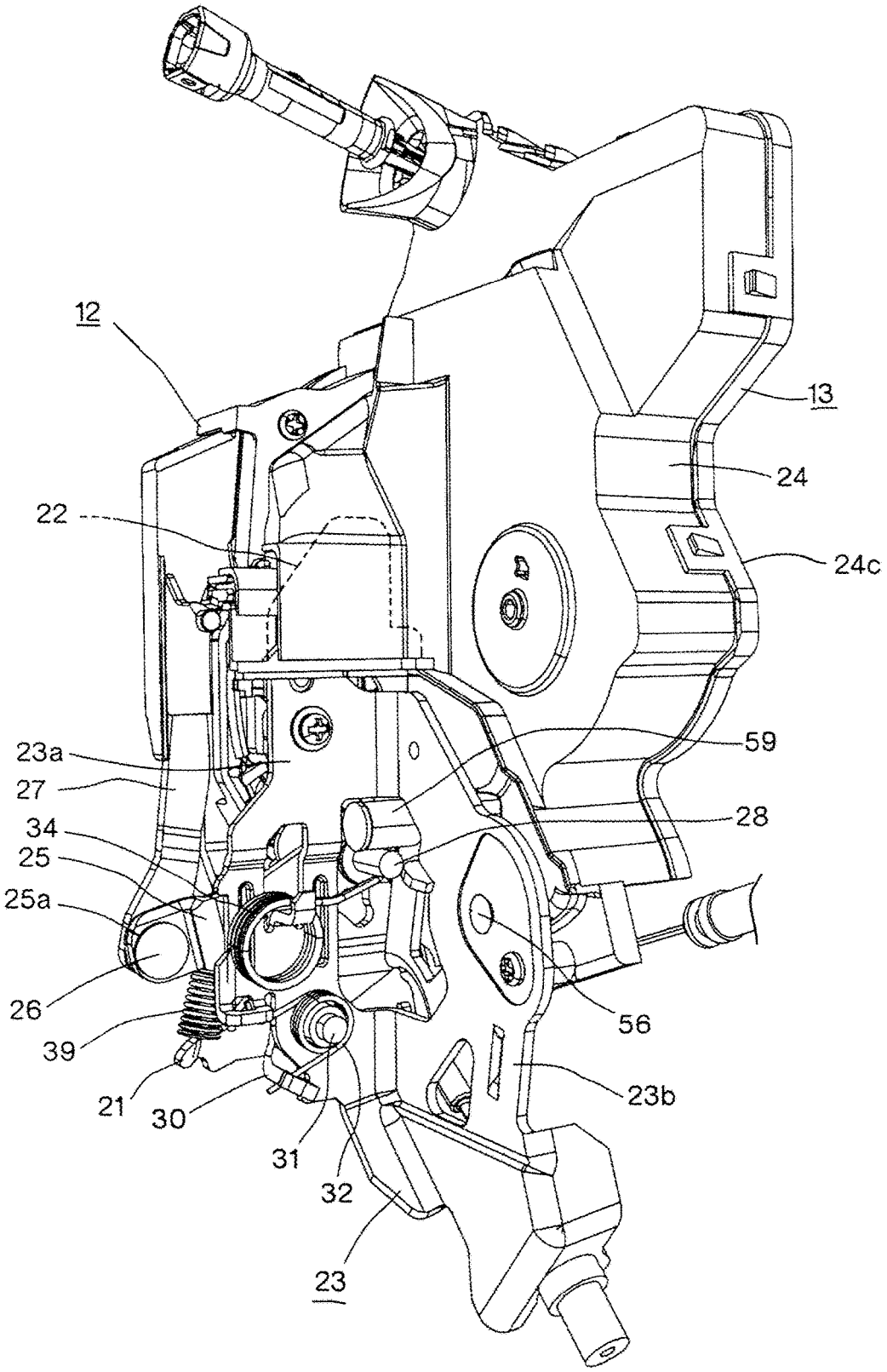
FIG. 4 is a rear perspective view of the latch unit and the operation unit of the vehicle latch apparatus.

As shown in FIG. 4, upper metal back plate 22 and lower L-shaped metal bracket 23 (see FIGS. 10, 11) are fixed to the rear surface of latch body 18. In FIG. 4, back plate 22 is generally covered with housing (latch housing) 24 of operation unit 13. Housing 24 has an L-shaped cross section, as seen from above. Back plate 22 and bracket 23 may be formed in a single metal plate. Bracket 23 has fixed lateral plate 23*a* that is parallel with the door width direction and fixed vertical plate 23*b* that is parallel with the door panel, and the lower part of L-shaped main casing 24*a* of housing 24 is fixed to fixed vertical plate 23*b*.

Figure 12:
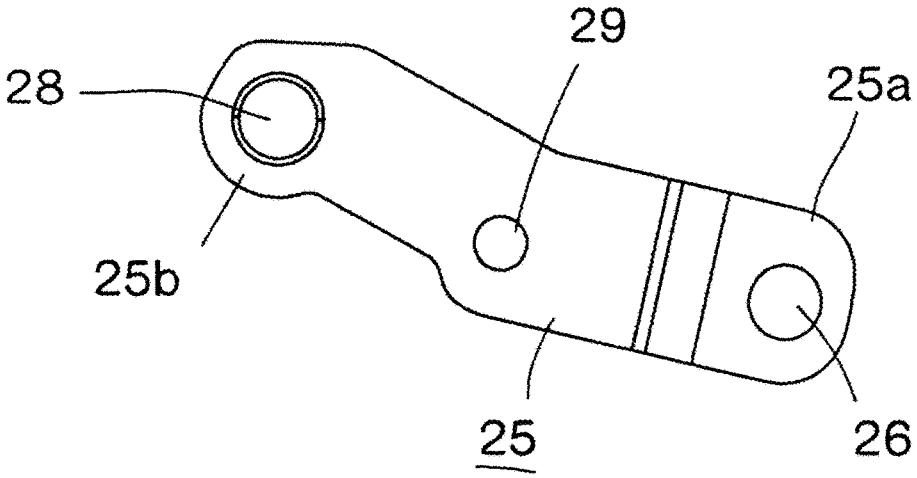
FIG. 12 is a front view of the first cinching lever.

First cinching lever 25 (FIG. 12) that extends substantially horizontally is arranged between latch body 18 and fixed lateral plate 23*a* of bracket 23. The lower end of second cinching lever 27 is connected to one end 25*a* of first cinching lever 25 via connecting pin 26. Follower pin 28 is provided at another end 25*b* of first cinching lever 25. As described later, the driving force of power unit 14 is transmitted to follower pin 28, and follower pin 28 is pushed and moved downward by the driving force.

Figure 5:
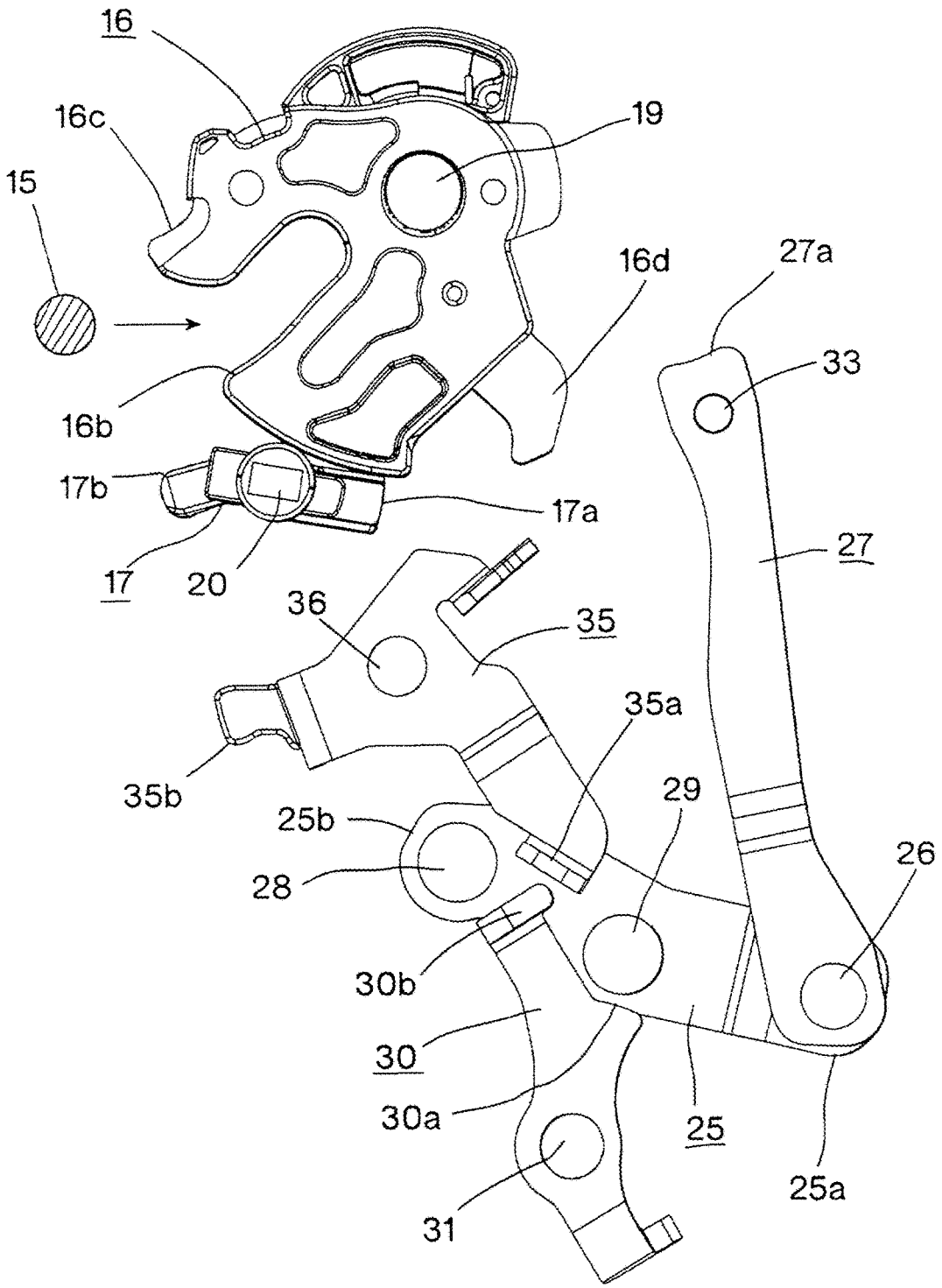
FIG. 5 is a partial front view of the powered cinching mechanism of the vehicle latch apparatus in the waiting position.
Figure 13:
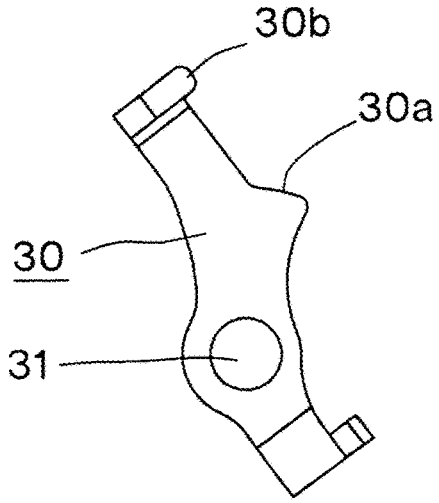
FIG. 13 is a front view of the clutch lever.

As shown in FIG. 5, movable shaft 29 that extends in the vehicle front-rear direction is provided on first cinching lever 25 at the center thereof in the vehicle width direction. Movable shaft 29 is fixed to first cinching lever 25. Clutch lever 30 (FIG. 13) is arranged below first cinching lever 25 and is rotatably supported by fixed lateral plate 23*a* of bracket 23 or an immobile element, such as cover plate 21, by means of shaft 31. Clutch lever 30 is biased in the clockwise direction in FIG. 5 by clutch spring 32 (FIG. 4).

Clutch lever 30 is provided with generally horizontal bearing surface 30*a*, which supports movable shaft 29 of first cinching lever 25 from below. Movable shaft 29 is only placed on bearing surface 30*a* and is not rotatably supported by any immobile element, such as latch body 18 or bracket 23. First cinching lever 25 works based on the principle of leverage, in which follower pin 28 is the point of effort, connecting pin 26 is the point of load and movable shaft 29 (bearing surface 30*a*) is the fulcrum. When the driving force of power unit 14 pushes down follower pin 28, which is the point of effort, first cinching lever 25 is rotated about the "fulcrum" in the anticlockwise direction and raises second cinching lever 27.

Guide pin 33 is provided in the upper part of second cinching lever 27. Guide pin 33 slidably engages vertical guide groove 18*b* that is formed on the front surface of latch body 18. Latch pushing end 27*a* is provided at the top end of second cinching lever 27. Latch pushing end 27*a* can abut against latch arm 16*d* of latch 16 in the half-latched position when latch pushing end 27*a* is raised, and thus latch pushing end 27*a* can rotate latch 16 to the fully-latched position.

When the door is open, first cinching lever 25 is biased in the clockwise direction in FIG. 5 by the elastic force of cinching spring 34 (FIG. 4) and is kept at the waiting position, as shown in FIG. 5. In the waiting position shown in FIG. 5, latch arm 16*d* of latch 16 is on the lateral side of latch pushing end 27*a* of second cinching lever 27 and is not opposite to latch pushing end 27*a*. In the state shown in FIG. 5, when the vehicle door is moved in the door closing direction by the manual door closing force and latch 16 is rotated to the half-latched position, latch arm 16*d* of latch 16 is positioned above or substantially above latch pushing end 27*a*. Further, power unit 14 is activated in the half-latched position in order to rotate first cinching lever 25 in the anticlockwise direction and raise second cinching lever 27. Thus, latch pushing end 27 of second cinching lever 27 abuts against the lower surface of latch arm 16*d* of latch 16 in the half-latched position, rotates latch 16 to the fully-latched position, and the door is fully closed by the motor power. This is called the powered cinching mechanism.

As described above, movable shaft 29 of first cinching lever 25 is only supported by bearing surface 30*a* of clutch lever 30 from below. This feature largely contributes to disconnecting the power transmission path between power unit 14 and second cinching lever 27. Specifically, the power transmission path can be disconnected by depriving movable shaft 29 (bearing surface 30*a*), which is the fulcrum of lever, from functioning as a "fulcrum". The power transmission path can be quite easily disconnected by rotating clutch lever 30 in the anticlockwise direction in FIG. 5 in order to remove the support of movable shaft 29. The friction force when bearing surface 30*a* is disconnected from movable shaft 29 is much smaller than the friction force when latch pushing end 27*a* is moved to the lateral side of latch arm 16*d*. Therefore, clutch lever 30 can be rotated in the disconnecting direction by a very small operational force.

Emergency lever 35 is rotatably supported by an immobile element, such as latch body 18, via shaft 36 that extends in the vehicle front-rear direction above another end 25*b* of first cinching lever 25. Emergency lever 35 is arranged on the rear side of latch body 18. Bent portion 35*a* of emergency lever 35 is opposite to abutting part 30*b* of clutch lever 30. Emergency lever 35 is biased in the anticlockwise direction in FIG. 5 by a spring (not illustrated) and can rotate clutch lever 30 in the disconnecting direction (in the anticlockwise direction in FIG. 5) by being rotated in the clockwise direction against the elastic force of the spring.

Figure 6:
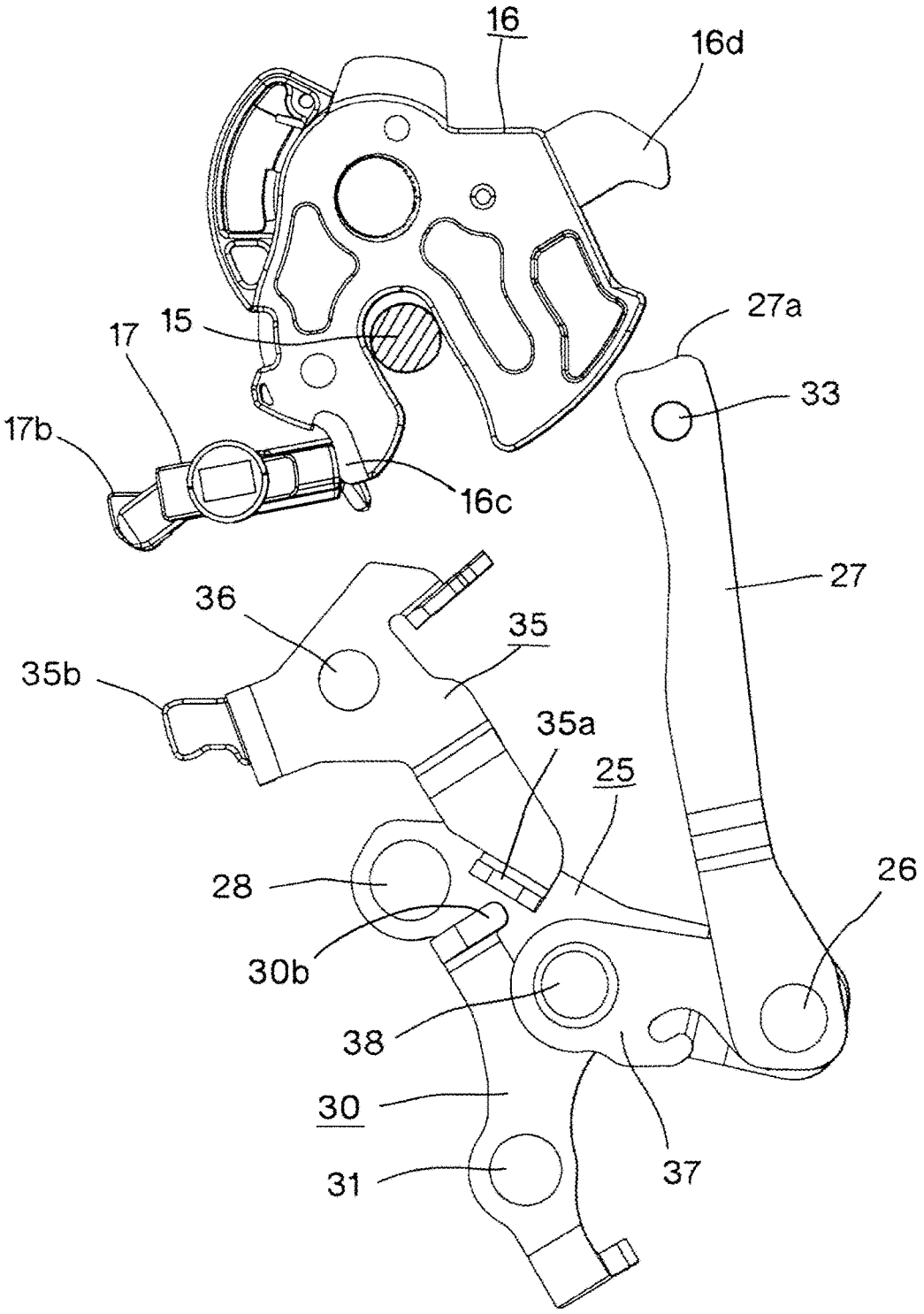
FIG. 6 is a front view of a part of the powered cinching mechanism and the return lever of the vehicle latch apparatus in the fully-latched position.

As shown in FIG. 6, the pivoting end of return lever 37 is also connected to lower connecting pin 26 of second cinching lever 27. The base of return lever 37 is rotatably supported by cover plate 21 via shaft 38. Shaft 38 is separated from movable shaft 29. The axis of movable shaft 29 preferably matches the axis of shaft 38 seen in the vehicle front-rear direction when first cinching lever 25 is in the waiting position, but the former does not need to completely match the latter. Return lever 37 is biased in the clockwise direction in FIG. 6 by return spring 39 (FIG. 4). When movable shaft 29 of first cinching lever 25 no longer functions as a "fulcrum", return lever 37 quickly lowers second cinching lever 27 in the raised position to the lower waiting position by the elastic force of return spring 39 in order to instantaneously allow latch 16 to rotate in the releasing direction Clutch lever 30 is rotated in the clockwise direction by the elastic force of clutch spring 32 when it is disconnected from emergency lever 35. Bearing surface 30*a* returns to the waiting position shown in FIG. 5 that is beneath movable shaft 29 of first cinching lever 25 that ceased to function as a "fulcrum". In the waiting position shown in FIG. 5, bearing surface 30*a* of clutch lever 30 is preferably opposite to movable shaft 29 with a slight gap therebetween. This enables clutch lever 30 to smoothly return due to the elastic force of clutch spring 32. It should be noted that when first cinching lever 25 is rotated in the anticlockwise direction by power unit 14, first cinching lever 25 is lowered by a distance that is equal to the gap and then restores the function of the "fulcrum" when it abuts against bearing surface 30*a*

Figure 7:
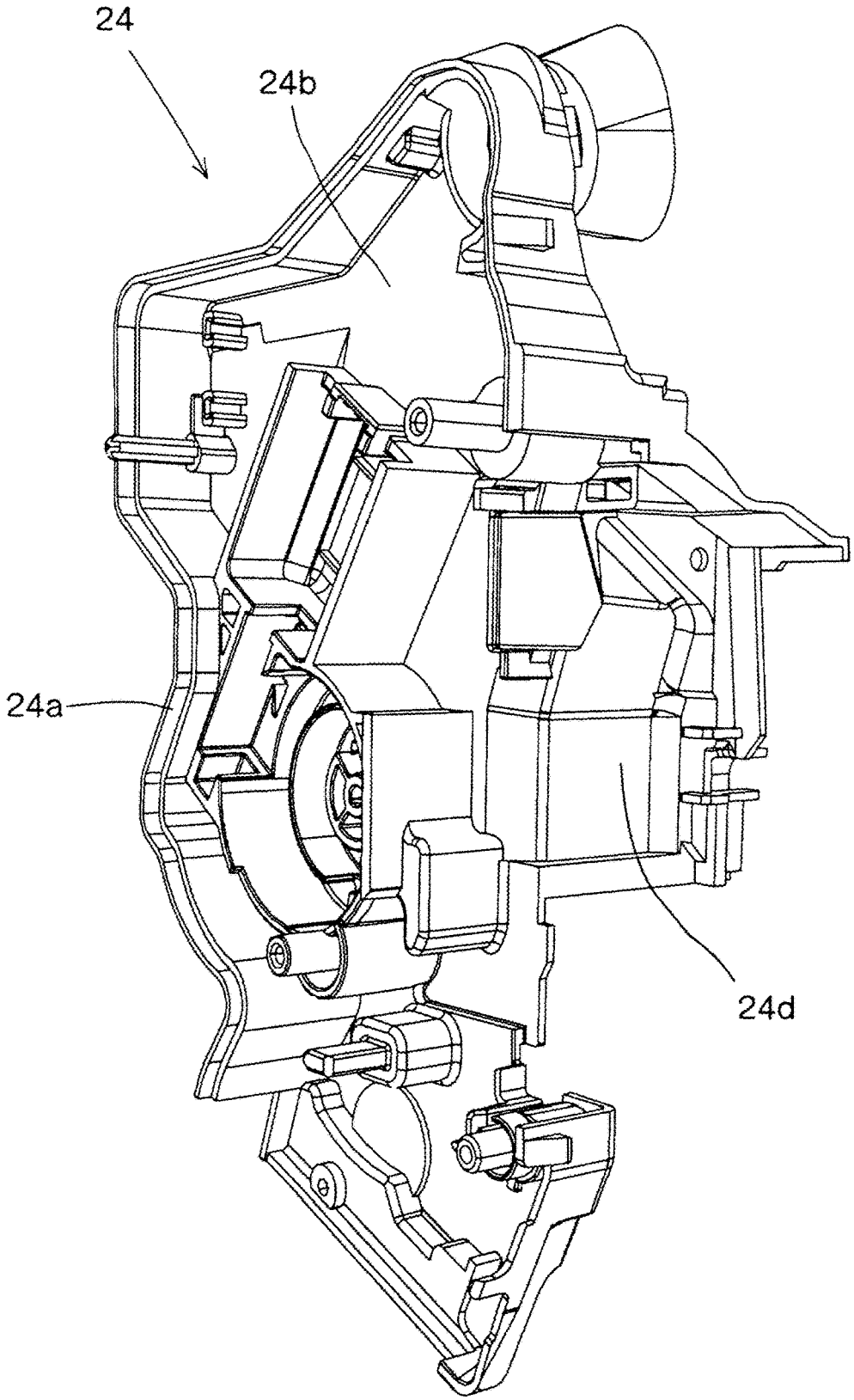
FIG. 7 is a front perspective view of the main casing of the housing of the operation unit.

As shown in FIG. 7, housing 24 of operation unit 13 includes L-shaped main casing 24*a* and casing cover 24*c* (FIGS. 2, 8) that covers side housing portion 24*b* of main casing 24*a*. Side housing portion 24*b* extends in parallel with fixed vertical plate 23*b* of bracket 23, houses main elements shown in FIG. 9 and is covered with casing cover 24*c*. Main casing 24*a* also includes front housing portion 24*d* that extends in parallel with fixed lateral plate 23*a* of bracket 23 and that is bent from housing portion 24*b* to form an L shape together with side housing portion 24*b*. Front housing portion 24*d* preferably houses the rear part of latch unit 12 and a part of latch body 18.

Side housing portion 24*b* houses motor 40 that opens the door and that is much smaller than power unit 14. Cylindrical worm gear 41 of motor 40 engages worm wheel gear 42, which is rotatably supported by main casing 24*a* via wheel shaft 42*b* that extends in the door width direction. Cam groove 42*a* is formed on the wheel surface. Worm wheel gear 42 is housed in side housing portion 24*b*.

In the vicinity of worm wheel gear 42, door opening lever 43 is rotatably supported by main casing 24*a* via door opening shaft 44 that extends in the door width direction. Follower pin 45 is formed on cam arm 43*a* of door opening lever 43 that extends leftward in FIG. 9. Follower pin 45 is slidably engaged with cam groove 42*a*. Door opening lever 43 is housed in side housing portion 24*b*.

Figure 9:
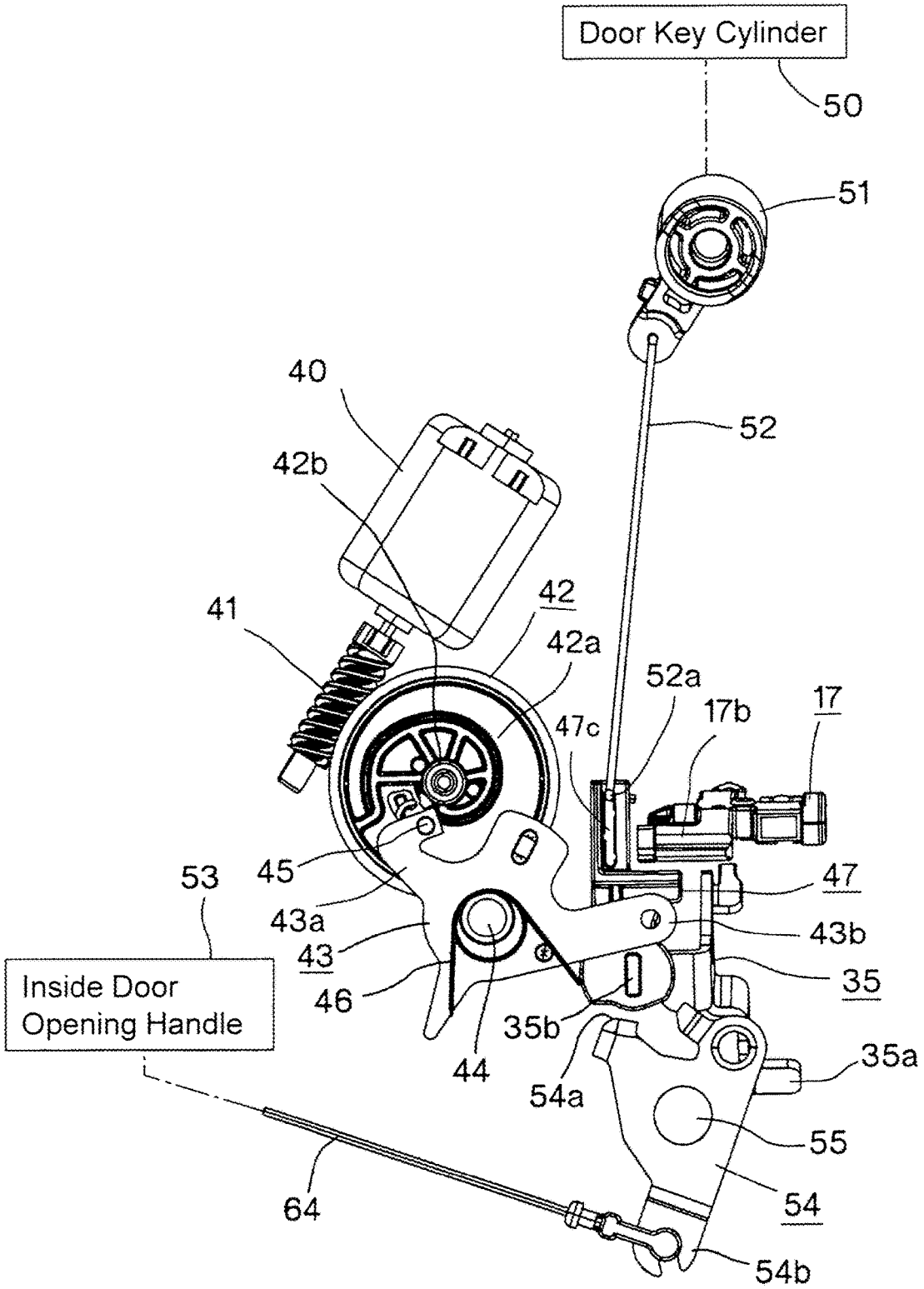
FIG. 9 is a side view of the various elements that are housed in the side housing portion of the main casing.

Worm wheel gear 42 is usually kept at the position illustrated in FIG. 9 by the elastic force of a return spring, not illustrated. When worm wheel gear 42 is rotated in the clockwise direction by means of motor 40, door opening lever 43 is pushed outward by cam groove 42*a* and is rotated in the anticlockwise direction against the elastic force of opening spring 46.

Figure 14:
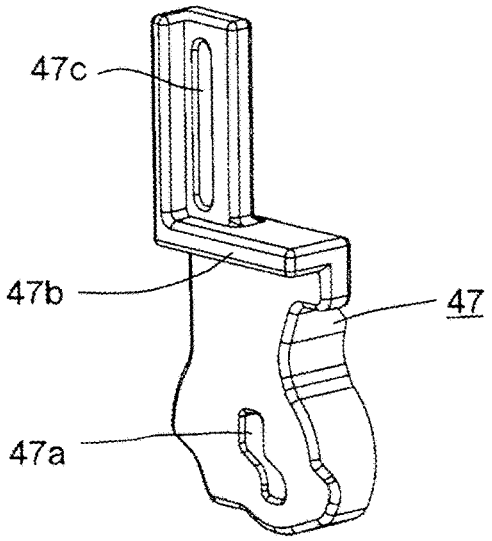
FIG. 14 is an enlarged perspective view of the door opening link.
Figure 15:
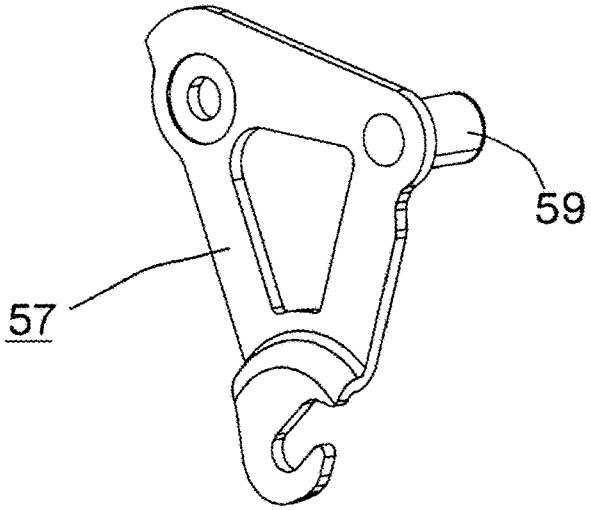
FIG. 15 is an enlarged perspective view of the power lever.
Figure 16:
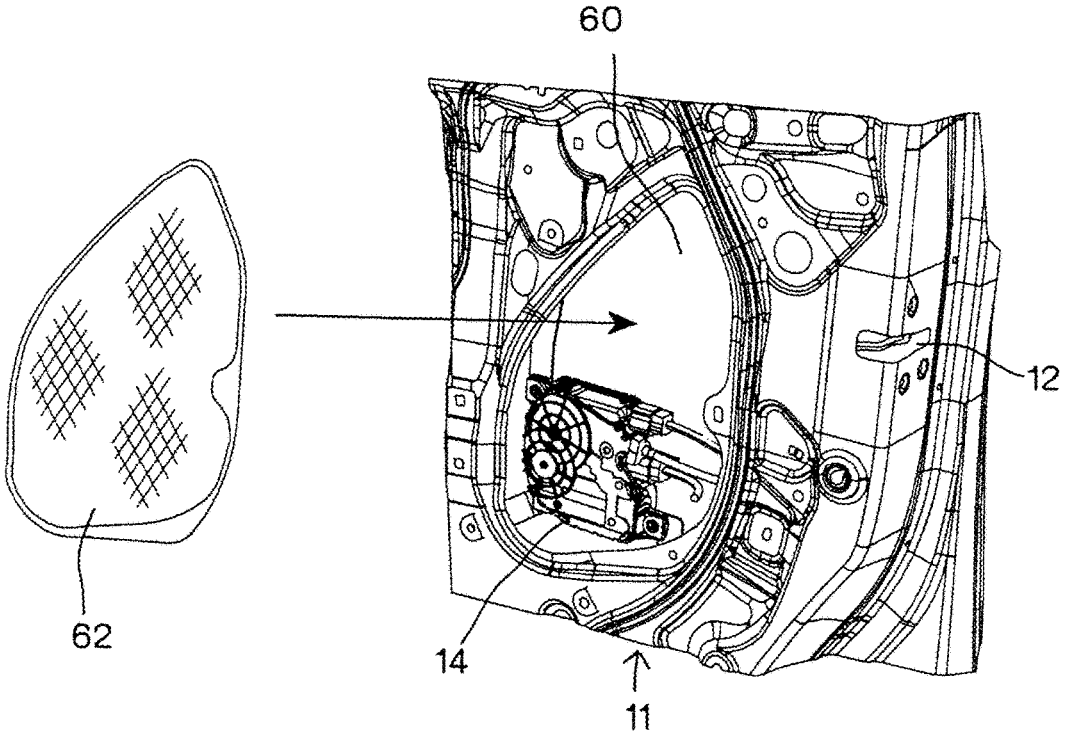
FIG. 16 is an explosive perspective view of the inside door panel and the sound insulating and absorbing cover.
Figure 17:
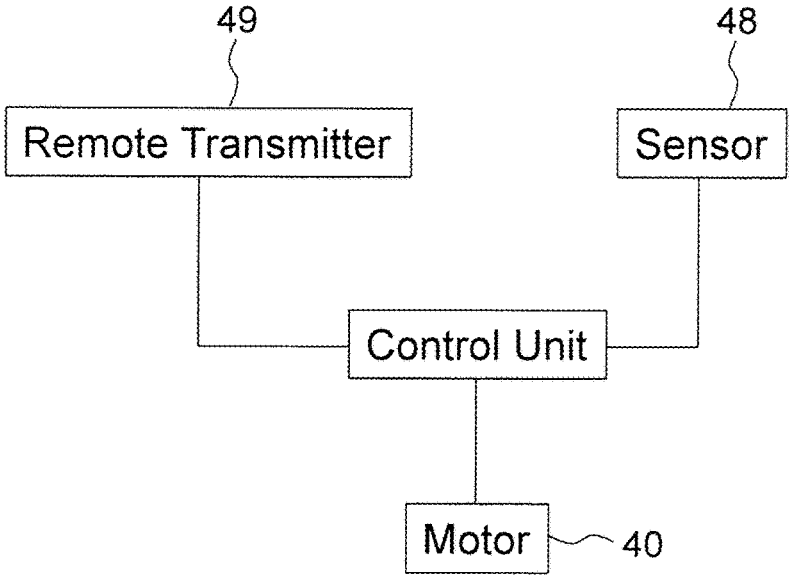
FIG. 17 is a block diagram of control.
Figure 18:
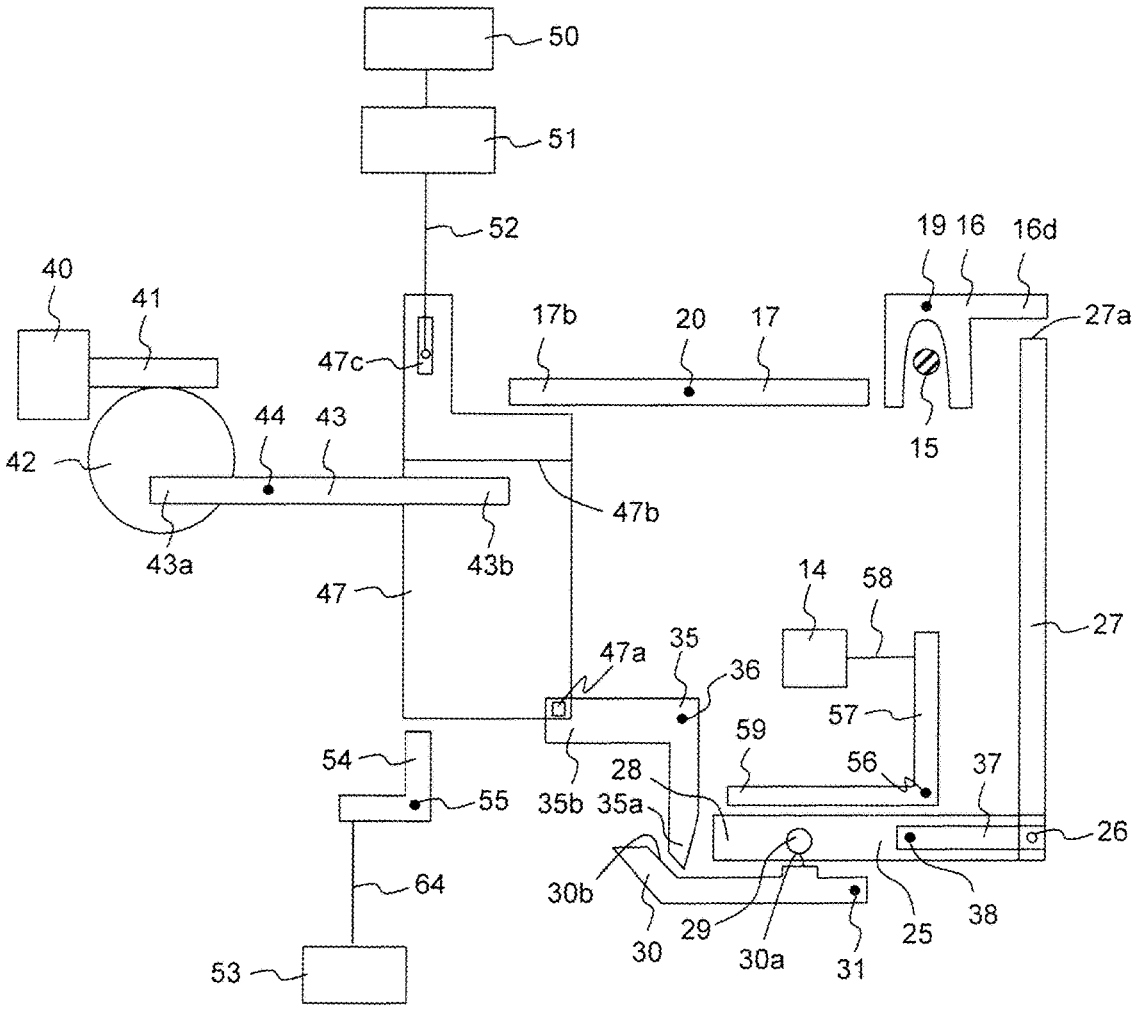
FIG. 18 is a conceptual view showing the connection of various elements of the vehicle latch apparatus, wherein the black circles in the figure show fixed rotational axes.

Vertical door opening link 47 (FIG. 14) is arranged such that it overlaps abutting arm 43*b* of door opening lever 43 that extends rightward in FIG. 9. Connecting hole 47*a* is provided in the lower part of door opening link 47, and tip end of connecting arm 35*b* of emergency lever 35 (FIG. 5) is inserted through and connected to connecting hole 47*a* such that emergency lever 35 is rotated in the clockwise direction in FIG. 5 when door opening link 47 is raised. Door opening link 47 is housed in the front part of side housing portion 24*b*.

Bent abutting part 47*b* is provided at or near the center of door opening link 47 in the vertical direction. The end of abutting arm 43*b* of door opening lever 43 that extends rightward in FIG. 9 is opposite to the lower surface of bent abutting part 47*b* so that door opening link 47 is raised when door opening lever 43 is rotated in the anticlockwise direction in FIG. 9 by the driving force of motor 40.

Ratchet pin 17*b* that is positioned at the end of ratchet 17 is opposite to the upper surface of bent abutting part 47*b* of door opening link 47 such that ratchet 17 is rotated in the clockwise direction in FIG. 3 against the elastic force of a ratchet spring (not illustrated) when door opening link 47 is raised. Ratchet 17 is disengaged from latchet 16 and the door is placed in the openable state.

Since motor 40 that disengages ratchet 17 from latch 16 by motor power is housed in side housing portion 24*b* of housing 24 that is covered with casing cover 24*c*, the operation noise is shielded and sound pressure is limited within an appropriate range. The driving force of motor 40 is transmitted through cam groove 42*a* that is formed on wheel gear 42 and follower pin 45 that is formed on door opening lever 43. This achieves proper sound pressure and sound quality.

In principal, door opening lever 43 (door opening link 47) of the present invention is rotated in the opening direction (moved in the opening direction) by the driving force of motor 40. Motor 40 is activated by a detection signal from sensor 48 that is provided on a door grip of a vehicle door or the like or by an opening signal from remote transmitter 49 that is held by a driver. Accordingly, the present invention provides vehicle door latch apparatus 10 in which a so-called "locking mechanism" that is used to shift between the locked state and the unlocked state and that is essential in the conventional vehicle door latch apparatus is omitted and whose structure is quite simple. In other words, disconnecting means to disconnect the power transmission path, such as "locking mechanism" can be omitted. This is because motor 40 can only be activated by a specific person.

In order to cope with malfunction of motor 40 or of the related power transmission path, two safety measures are adopted. The first measure is achieved by door key cylinder 50 (FIG. 9). Door key cylinder 50 is provided on the outside metal door panel (not illustrated) of a vehicle door. A conventional door key cylinder is connected to "locking mechanism" used to shift between the locked state and the unlocked state, which is not provided in the present invention. On the other hand, in the present invention, door key cylinder 50 is connected to door key lever 51 that is provided in side housing portion 24*b* of housing 24. Key lever 51 is arranged above door opening link 47 and engages the upper end of connecting rod 52. Bottom end 52*e* of connecting rod 52 is connected to vertical slot 47*c* of door opening link 47 with play in the vertical direction. Due to the play, door opening link 47 can be raised by means of motor 40 without moving door key lever 51.

Due to this arrangement, by rotating door key cylinder 50 by means of a proper key plate, it is possible for door opening link 47 to be raised under unexpected circumstances via connecting rod 52, to disengage ratchet 17 from latch 16 and thereby to place the door in the openable state.

Figure 8:
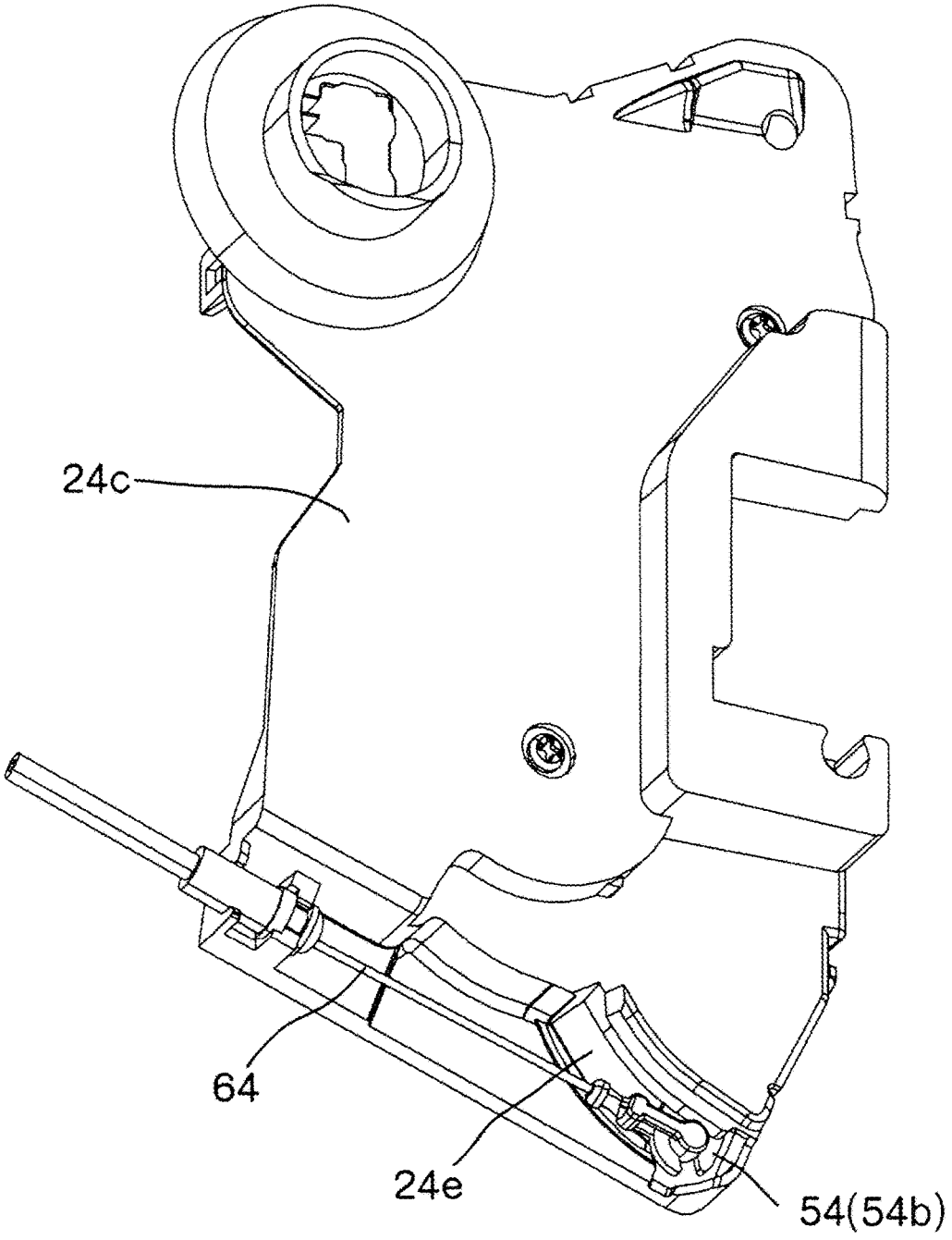
FIG. 8 is a perspective view of the casing cover that covers the main casing of the housing, as seen from the inside of the vehicle.

The second measure is achieved by providing inside door opening handle 53 on the inner side of a vehicle door and by connecting inner lever 54 that is provided in side housing portion 24*b* of housing 24 to inside door opening handle 53 via cable 64. Inner lever 54 is rotated in the clockwise direction about inner shaft 55 in FIG. 9 by the door opening operation of inside door opening handle 53. When abutting end 54*a* of inner lever 54 abuts against the lower end of door opening link 47, door opening link 47 is raised to disengage ratchet 17 from latch 16 and thereby to place the door in the openable state. As shown in FIG. 8, cable connection 54*b* of inner lever 54 is exposed via gap 24*e* of casing cover 24*c*, and cable 64 is connected to cable connection 54*b* that is exposed.

In the arrangement described above, the structure in which the bottom part of door opening link 47 is supported by connecting arm 35*b* of emergency lever 35 is also advantageous. In daily operation, door opening link 47 that is only raised by the power of motor 40 activates clutch lever 30 via emergency lever 35 in order to inactivate the "fulcrum" of first cinching lever 25 each time door opening link 47 is raised. Accordingly, even when second cinching lever 27 is stopped at the upper fully-latched position due to a malfunction of power unit 14, second cinching lever 27 quickly returns to the lower waiting position due to the elastic force of return spring 39 in order to allow latch 16 to rotate in the releasing direction without any interference from second cinching lever 27 because when motor 40 is activated by an operation signal, the "fulcrum" of first cinching lever 25 is simultaneously inactivated.

In addition, the arrangement in which door opening link 47 is supported by emergency lever 35 simplifies the structure and enables rational design.

Figure 10:
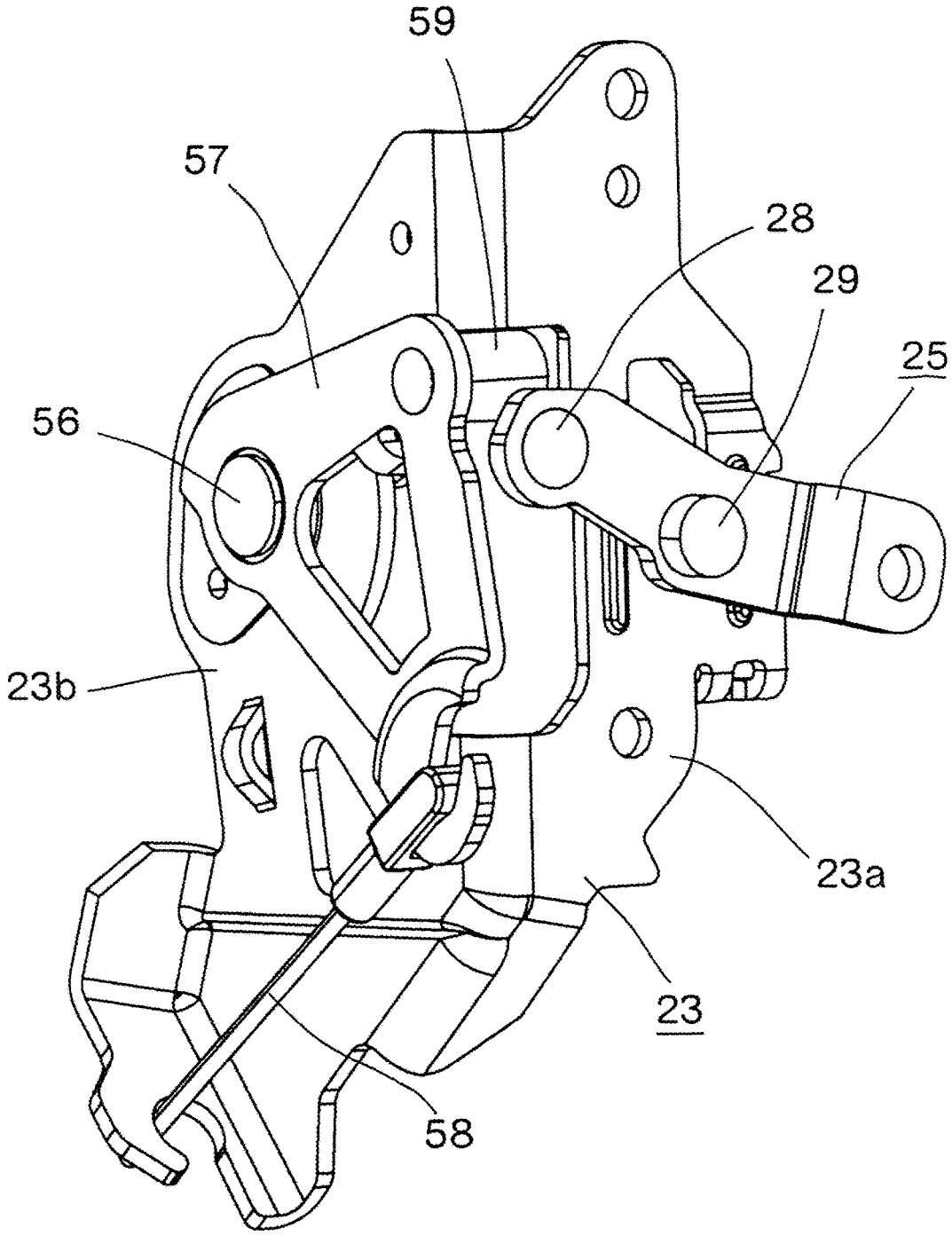
FIG. 10 is a front perspective view of the L-shaped bracket, the power lever and the first cinching lever.
Figure 11:
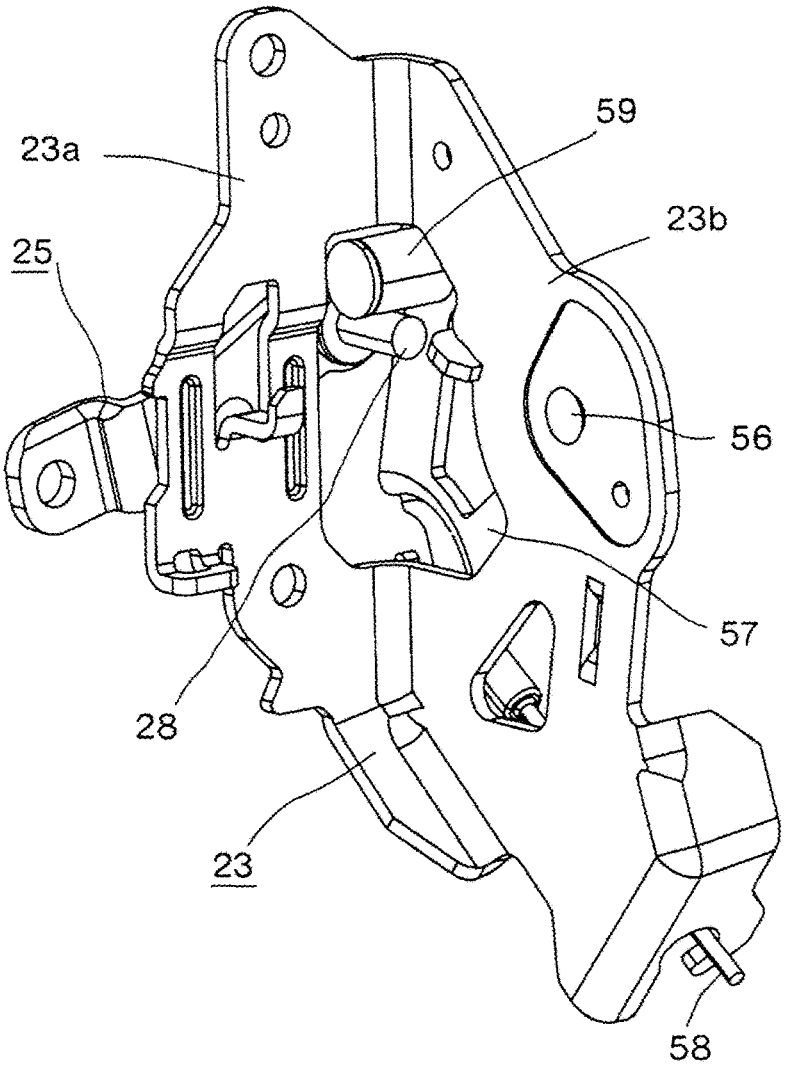
FIG. 11 is a rear perspective view of the L-shaped bracket, the power lever and the first cinching lever.

As shown in FIGS. 10, 11, power lever 57 is rotatably supported by the lower part of fixed vertical plate 23*b* of bracket 23 via shaft 56 that extends in the door width direction.

Power lever 57 is connected to power unit 14 via cable 58. Power lever 57 is provided with abutting pin 59 that extends in the door width direction. Abutting pin 59 engageably faces follower pin 28 of first cinching lever 25. When power lever 57 is rotated due to the power of power unit 14, abutting pin 59 pushes down follower pin 28, rotates first cinching lever 25 in the anticlockwise direction in FIG. 5, raises second cinching lever 27 and thereby rotates latch 16 from the half-latched position to the fully-latched position in order to close the door.

As shown FIG. 1, power unit 14 is arranged such that it overlaps service hole 60 of inside door panel 11, as seen in the door width direction and is fixed to inside door panel 11 by means of attachment plates 61. After power unit 14 is fixed to inside door panel 11, service hole 60 is covered with sound isolating and absorbing cover 62.

Power unit 14 is a sound proofing closed unit having housing 63 that houses motor 40 and a reduction gear unit. As compared to an arrangement in which power unit 14 is arranged on the back side of a metal surface of inside door panel 11 and in which power unit 14 overlaps the metal surface of inside door panel 11 in the door width direction, excellent sound pressure and sound quality can be obtained due to the synergy of the sound isolating and absorbing effect of housing 63 and sound insulating and absorbing cover 62.

Although certain preferred embodiments of the present invention have been shown and described in detail, it should be understood that various changes and modifications may be made without departing from the spirit or scope of the appended claims.

LIST OF REFERENCE NUMBERS

10 vehicle door latch apparatus
11 inside door panel
12 latch unit
13 operation unit
14 power unit
15 striker
16 latch
16 *a* striker engaging groove
16 *b* half-latching step
16 *c* full-latching step
16 *d* latch arm
17 ratchet
17 *a* engaging end
17 *b* ratchet pin
18 latch body
18 *a* striker passage
18 *b* guide groove
19 latch shaft
20 ratchet shaft
21 cover plate
21 *a* notched passage
22 back plate
23 bracket
23 *a* fixed lateral plate
23 *b* fixed vertical plate
24 housing
24 *a* main casing
24 *b* side housing portion
24 *c* casing cover
24 *d* front housing portion
24 *e* gap
25 first cinching lever
25 *a* one end
25 *b* another end
26 connecting pin
27 second cinching lever
27 *a* latch pushing end
28 follower pin
29 movable shaft
30 clutch lever
30 *a* bearing surface
30 *b* abutting part
31 shaft
32 clutch spring
33 guide pin
34 cinching spring
35 emergency lever
35 *a* bent portion
35 *b* connecting arm
36 shaft
37 return lever
38 shaft
39 return spring
40 motor
41 worm gear
42 wheel gear
42 *a* cam groove
42 *a* wheel shaft
43 door opening lever
43 *a* cam arm
43 *b* abutting arm
44 door opening shaft
45 follower pin
46 opening spring
47 door opening link
47 *a* connecting hole
47 *b* bent abutting part
47 *c* vertical slot
48 sensor
49 remote transmitter
50 door key cylinder
51 door key lever
52 connecting rod
52 *a* bottom end
53 inside door opening handle
54 inner lever
54 *a* abutting end
54 *b* cable connection
55 inner shaft
56 shaft
57 power lever
58 cable
59 abutting pin
60 service hole
61 attachment plate
62 sound insulating and absorbing cover
63 housing
64 cable

What is claimed is:

1. A vehicle side door latch apparatus comprising:

a latch that has a half-latching step that defines a half-latched position and a fully-latching step that defines a fully-latched position and that is rotated from an unlatched position toward the fully-latched position by engaging a striker;

a ratchet that engages the half-latching step and the fully-latching step in order to prevent the latch from being rotated in a releasing direction;

a door opening link that is moved in a door opening direction from a waiting position in order to abut against the ratchet in order to allow the ratchet to be disengaged from the latch;

a motor that moves the door opening link in the door opening direction from the waiting position;

a door key lever that is connected to the door opening link with play in the door opening direction, wherein the door key lever moves the door opening link in the door opening direction from the waiting position by being rotated in the door opening direction by a key plate;

a power transmission path that does not have disconnecting means thereof and that always transmits power of the motor to the door opening link;

a first cinching lever that moves the latch from the half-latched position to the fully-latched position;

a power unit that rotates the first cinching lever;

a clutch lever that supports the first cinching lever; and an emergency lever having one end that is connected to the door opening link and another end that is opposite to the clutch lever, wherein the first cinching lever has a central movable shaft, and the clutch lever has a bearing surface that only abuts against a lower surface of the movable shaft in order to support the movable shaft, and the first cinching lever is vertically supported only by the bearing surface, wherein the emergency lever is rotated by the door opening link being moved in the door opening direction, whereby said another end of the emergency lever abuts against and rotates the clutch lever and moves the bearing surface downward away from the movable shaft, and wherein the first cinching lever is located apart from the bearing surface and is supported by the bearing surface when the first cinching lever is rotated by the power unit and abuts against the bearing surface.

2. The vehicle side door latch apparatus according to claim 1, further comprising an inner lever that is rotated in the door opening direction by a door opening operation of an inside door opening handle of a vehicle door, wherein the inner lever abuts against the door opening link by being rotated in the door opening direction and moves the door opening link in the door opening direction.

3. The vehicle side door latch apparatus according to claim 1, wherein the power unit is arranged on an outer side of a metal inside door panel of a vehicle door such that the power unit overlaps a service hole of the inside door panel, as seen in a door width direction, wherein the service hole is covered with a sound insulating and absorbing cover.

4. The vehicle side door latch apparatus according to claim 3, further comprising a soundproofing closed housing that houses the power unit.

5. A vehicle side door latch apparatus comprising:

a housing that includes a side housing portion and a front housing portion that is bent from the side housing portion, wherein the housing is formed in an L-shape, as seen from above;

a latch that is housed in the front housing portion, that has a half-latching step that defines a half-latched position and a fully-latching step that defines a fully-latched position and that is rotated from an unlatched position toward the fully-latched position by engaging a striker;

a ratchet that is housed in the front housing portion, that engages the half-latching step and the fully-latching step in order to prevent the latch from being rotated in a releasing direction and that is rotated about a ratchet shaft that extends in a vehicle front-rear direction of a vehicle;

a door opening link that is housed in the side housing portion, that is moved upward in a door opening direction from a waiting position below in order to abut against the ratchet to allow the ratchet to be disengaged from the latch;

a door opening lever that is housed in the side housing portion and that is rotated in the door opening direction about a door opening shaft that extends in a door width direction in order to move the door opening link that is in the waiting position in the door opening direction;

a motor that is housed in the side housing portion and that moves the door opening lever in the door opening direction;

a power unit that is arranged apart from the housing and that rotates the first cinching lever;

a first cinching lever that is housed in the front housing portion and that is rotated about a movable shaft that extends in the vehicle front-rear direction by power of the motor in order to move the latch from the half-latched position to the fully-latched position;

a door key lever that is housed in the side housing portion and that is connected to the door opening link with play in the door opening direction, wherein moves the door opening link in the door opening direction from the waiting position by being rotated in a door opening direction by a key plate;

a casing cover that is attached to the side housing portion and that isolates the motor, the door opening lever and the door opening link from outside of the casing cover; and a power transmission path that does not have disconnecting means thereof and that always transmits power of the motor to the door opening link via the door opening lever;

a clutch lever that supports the first cinching lever; and an emergency lever having one end that is connected to the door opening link and another end that is opposite to the clutch lever, wherein the door opening lever is arranged between the door opening link and the motor, as seen in the vehicle front-rear direction, the door key lever is arranged above the door opening link, and the ratchet shaft is arranged between the latch shaft and the movable shaft in a vertical direction, wherein the first cinching lever has a central movable shaft, and the clutch lever has a bearing surface that only abuts against a lower surface of the movable shaft in order to support the movable shaft, and the first cinching lever is vertically supported only by the bearing surface, wherein the emergency lever is rotated by the door opening link being moved in the door opening direction, whereby said another end of the emergency lever abuts against and rotates the clutch lever and moves the bearing surface downward away from the movable shaft, and wherein the first cinching lever is located apart from the bearing surface and is supported by the bearing surface when the first cinching lever is rotated by the power unit and abuts against the bearing surface.

* * * * *